United States Patent [19]

Tsuneki et al.

[11] Patent Number: 4,724,125

[45] Date of Patent: Feb. 9, 1988

[54] METHOD FOR CORROSION INHIBITION OF METALS

[75] Inventors: Takao Tsuneki, Ebina; Shinji Ano, Yokohama; Takahiko Uchida, Yamato; Tomoyasu Imai, Kawasaki, all of Japan

[73] Assignee: Kurita Water Industries Ltd., Tokyo, Japan

[21] Appl. No.: 911,923

[22] Filed: Sep. 24, 1986

[30] Foreign Application Priority Data

Sep. 25, 1985 [JP] Japan ..... 60-211759

[51] Int. Cl.[4] ..... C23F 11/10

[52] U.S. Cl. ..... 422/17; 252/388; 252/389.3; 252/396

[58] Field of Search ..... 422/14, 17; 252/388, 252/396, 389.3

[56] References Cited

PUBLICATIONS

Betz Handbook of Industrial Water Conditioning 7th Edition, 1976, pp. 178–181, and 188.

*Primary Examiner*—Barry S. Richman
*Assistant Examiner*—William R. Johnson
*Attorney, Agent, or Firm*—Frank J. Jordan; C. Bruce Hamburg; Manabu Kanesaka

[57] ABSTRACT

Metal materials in contact with aqueous systems are prevented from corrosion by a method which comprises adding a copolymer having a molecular weight in the range of 1,000 to 20,000 and formed between isobutylene and at least one member selected from among maleic acid, water-soluble salts thereof, and maleic anhydride to water of such quality that the Langelier index thereof is not less than 1.5 and the relation, $$(SiO_2)\times(CaH)\geqq 2{,}000$$

(wherein $(SiO_2)$ stands for the $SiO_2$ concentration in the water (mg/liter) and (CaH) for the calcium hardness (mg/liter as $CaCO_3$ in the water).

12 Claims, No Drawings

METHOD FOR CORROSION INHIBITION OF METALS

FIELD OF THE INVENTION AND RELATED ART STATEMENT

This invention relates to a method for corrosion inhibition of metals, and more particularly relates to a method for corrosion inhibition of metals, particularly a steel material, in contact with aqueous systems without causing the problem of toxicity and the problem of environmental pollution such as, for example, the eutrophication of lakes, rivers and closed sea areas.

In aqueous system such as an open-recirculating cooling water system, chiefly carbon steel is used as a base material for heat exchangers, pipes, etc. The steel material immersed in cooling water is corroded by dissolved oxygen, chlorine ion, sulfate ion, etc. contained in the water with the phenomenon of pitting. The pitting also occurs on such corrosion resistance materials as copper, copper alloy, and stainless steel.

For protecting metal materials exposed to aqueous systems against the aforementioned corrosion, therefore, corrosion inhibition agents have been commonly used. The corrosion inhibition agents used in the cooling water system, though soluble themselves in water, prevent the reaction of corrosion by forming an oxide film or a film insoluble or sparingly soluble in water on the surface of a metal material and reducing dissolution of metal ions from the metal material or reduction of dissolved oxygen.

As corrosion inhibition agents, such heavy metal salts as chromates and zinc salts, and (poly)phosphates and organic phosphorus compounds have been generally used.

A copolymer of maleic anhydride isobutylene has been proposed (Patent Application Disclosure No. SHO 53(1978)-92,349) as a polyelectrolyte for corrosion inhibition agent.

In the corrosion inhibition agents which have found adoption to date, chromates manifest an outstanding corrosion inhibition effect and, on the other hand, suffer from a drawback that they readily induce local corrosion at a low application concentration. Further, since chromates are highly toxic and their leak from the water systems is strictly regulated, the effluents from these aqueous systems must be treated and recovered. Zinc salts have room for further improvement in terms of corrosion inhibition ability. If they leak in effluents from the aqueous systems, they cause the problem of water pollution.

Further, for the protection of closed waters against eutrophication, regulations have recently limited the random release of phosphorus compounds.

In response to these circumstances, the desirability of developing a method which is capable of corrosion inhibition steel and other metal materials exposed to aqueous systems without entailing the problems of environmental pollution such as toxicity and eutrophication has been finding enthusiastic recognition.

The aforementioned maleic anhydride/isobutylene copolymer is desirable in the sense that it contains none of the substances subject to restrictions. This polymer, however, is not fully satisfactory because it lacks stability of performance when used alone.

OBJECT AND SUMMARY OF THE INVENTION

An object of this invention is to solve the aforementioned problems and to provide a method for corrosion inhibition steel and other metal materials exposed to water thereby manifesting satisfactory effects in reducing or preventing the corrosion.

Another object of this invention is to provide a method for preventing corrosion of metal without entailing the problems of toxicity and eutrophication.

Yet another object of this invention is to provide a method for corrosion inhibition of a metal material, which method manifests highly stable effects in reducing and preventing the corrosion.

These objects are attained by a method for corrosion inhibition of metal materials, which is characterized by adding a copolymer having a molecular weight in the range of 1,000 to 20,000 and formed between isobutylene and at least one member selected from among maleic acid, water-soluble salts thereof, and maleic anhydride to water of the quality having a Langelier index of not less than 1.5 and satisfying following the relation, $$(SiO_2)\times(CaH)=2{,}000$$

(wherein $(SiO_2)$ stand for the $SiO_2$ concentration in the water (mg/liter) and (CaH) for the calcium hardness (mg/liter) as $CaCO_3$ in the water).

DETAILED DESCRIPTION OF PREFERRED EMBODIMENTS

The inventors have found that in corrosion inhibition of metal materials in contact with aqueous systems, M alkalinity, calcium hardness, silica, etc. of the aqueous systems fulfil extremely important roles in the corrosion inhibition and that a satisfactory corrosion inhibition film can be formed on the surface of metal materials and otherwise inevitable corrosion of the metal materials cannot be effectively prevented by making efficient use of these important roles and adopting a polymer of high compatibility with the relevant components in the water system. They have continued a diligent study on this finding and, consequently, ascertained it to themselves that a satisfactory corrosion inhibition effect is obtained by adding a specific polymer of a molecular weight in the range of 1,000 to 20,000 to an aqueous system possessing a specific Langelier index and satisfying a specific $(SiO_2)\times(CaH)$ value as contemplated by this invention. They have completed this invention as the result. (Incidentally, the water system subjected to treatment as disclosed in Patent Application disclosure No. SHO 53(1978)-92,349 is specified to have a Langelier index approximately in the range of $-0.7$ to $+0.85$, a value notably smaller than the Langelier index of not less than 1.5 specified in this invention.)

Now, the present invention will be described in detail below.

The method of this invention comprises adding a copolymer having a molecular weight in the range of 1,000 to 20,000 and formed between isobutylene and at least one member selected from among maleic acid, water-soluble salts thereof, and maleic anhydride to water of the quality having a Langelier index of not less than 1.5, preferably not less than 1.8 and satisfying the relation, $(SiO_2)\times(CaH)\geqq 2{,}000$, preferably $(SiO_2)\times(CaH)\geqq 20{,}000$.

The term $(SiO_2)$ as used in this invention means the $SiO_2$ concentration (mg/liter) in the water and the term (CaH) similarly the calcium hardness (mg/liter as $CaCO_3$) in the water.

In the copolymer of isobutylene and a water-soluble salt of maleic acid intended for addition to the water under treatment, examples of water-soluble salts are, e.g. sodium salt, amine salt, ammonium salt, and lithium salt.

Specifically, as water-soluble salts of maleic acid, there may be cited monosodium maleate, disodium maleate, diammonium maleate, and monoamine maleate, for example.

The copolymer of isobutylene and at least one member selected from among maleic acid, water-soluble salts thereof, and maleic anhydride is produced, for example, by a method which comprises adding maleic acid, for instance, isobutylene, and dibenzyl peroxide to benzene, heating the resulting mixture at 54° C. for 14 hours to effect necessary reaction, and thereafter converting the reaction product with ammonia into a water-soluble salt or by a method which comprises subjecting isobutylene and maleic anhydride in isopropyl acetate as a solvent to precipitation copolymerization. In all the copolymers conceivable herein, the copolymer of isobutylene and maleic anhydride is hydrolyzed preparedly to its actual use. Optionally, the copolymer of isobutylene and maleic acid or maleic anhydride may be converted into a water-soluble salt after its production.

In the copolymer produced as described above, the total mol ratio of maleic acid, a water-soluble salt thereof, or maleic anhydride is generally required to exceed 10%, and preferably desired to fall in the range of 25 to 75%.

In the present invention, this copolymer is added to the aqueous system under treatment in a ratio approximately in the range of 1 to 500 mg/liter, preferably 2 to 100 mg/liter.

The method used for this addition is not specifically limited. For example, there can be cited a method which consists in cotinuously or intermittently injecting the copolymer in a stated concentration with an injector or a pump into the water system under treatment.

In the present invention, when the water system under treatment contains the calcium hardness component and the silica component in amounts such that the Langelier index is not less than 1.5 and the product of $(SiO_2)\times(CaH)$ is not less than 2,000, the added copolymer of this invention never fails to entrain the calcium hardness component and other components, form a satisfactory protective film on the surface of metal materials, and manifest an outstanding corrosion inhibition effect. This satisfactory corrosion inhibition effect is not obtained when the Langelier index is less than 1.5 or the product of $(SiO_2)\times(CaH)$ is less than 2,000. When the water in the aqueous system under treatment has quality such that the specified values are not satisfied, the quality of the water is to be adjusted by adding the calcium hardness component and/or the silica component or other component to the water at the same time that the copolymer is added thereto.

In the present invention, for this adjustment of the quality of water, there can be adopted a method which comprises suitably adding calcium chloride, slaked lime, or quick lime as the calcium hardness component, a water-soluble silicate consisting of $Na_2O$ and $SiO_2$ in a mol ratio in the range of 1/1 to $\frac{1}{3}$ as the silica component, optionally a bicarbonate as the M-alkalinity component, and sodium hydroxide or sodium carbonate as pH adjusting agent.

Further, in this invention, the aforementioned copolymer may be used in combination with other auxiliary corrosion inhibition agents or scale preventing agents or slime control agents. Concrete examples of such additives are carboxylic acids, oxycarboxylic acids, oxyacids, aminic acids, azoles such as benzotriazole and tolyltriazole, thiazoles such as mercaptobenzothiazole, homopolymer and copolymers of acrylamide, homopolymer and copolymer of acrylic acid, lignins, tannins, chlorine type compounds, bromine type compounds, ozone, and hydrazine.

The corrosion inhibition method of this invention which has been described above has the following operation and effect.

It is well known that generally, in the aqueous system such as an open recirculating cooling water system, when the cycles of concentration of cooling water is increased, the calcium ion and bicarbonate ion contents in the water are increased and the pH value of the water is similarly increased and the corrosion is reduced owing to the formation of a $CaCO_3$ film. As a scale for indicating the tendency toward the $CaCO_3$ precipitation in the aqueous system, the Langelier index has been proposed. It indicates the tendency of given water toward $CaCO_3$ precipitation as one standard, based on the calcium concentration, the M alkalinity, the total soluble solids content, the water temperature, and the pH. When the Langelier index exceeds 1.5, the suppression of the corroding property of water is enhanced because the tendency of the deposition of $CaCO_3$ scale is increased.

The silica contained in the water system also fulfils an extremely important part in the prevention of corrosion. In the Langelier index, however, the silica content of the water content is barely treated as one of the total soluble solids and the silica concentration is not directly indicated. A study made in search of the silica concentration in the water system which satisfactorily permits effective prevention of corrosion has revealed that in the samples of water which have Langelier indexes of not less than 1.5, only those which additionally satisfy the relation, $(SiO_2)\times(CaH)\geqq 2{,}000$, manifest a synergistic effect jointly with the specific polymer of this invention.

For the present invention, the requirements (1) through (3); i.e. that (1) the water system should possess a Langelier index of not less than 1.5, that (2) it should satisfy the relation, $(SiO_2)\times(CaH)\geqq 2{,}000$, and that (3) a copolymer having a molecular weight in the range of 1,000 to 20,000 and formed between isobutylene and at least one member selected from among maleic acid, water-soluble salts thereof, and maleic anhydride should be added to the aforementioned water system, are extremely important. This invention fails to give satisfactory results when any one of these three requirements is not met.

For example, even when the water system possesses a Langelier index of not less than 1.5 and satisfies the relation, $(SiO_2)\times(CaH)\geqq 2{,}000$, the corrosion inhibition effect aimed at by this invention is not obtained with other polymer (such as, for example, a maleic acid homopolymer which is described in Comparative Experiment 2 to be described afterward) or with the known scale inhibitor (such as, for example, sodium polyacrylate).

Even when the copolymer satisfying the requirement of (3) is used, no desirable corrosion inhibition effect is obtained if the water system has such quality that the requirements of (1) and/or (2) are not met.

The method of this invention for corrosion inhibition of metal materials, when applied to steel and other metal materials in contact with aqueous systems, manifests an outstanding effect in suppressing or preventing corrosion. Further, in accordance with this invention, the problem of toxicity is not raised because the effluent from the aqueous system contains no heavy metal and the problem of eutrophication is not caused because the effluent contains no phosphorus and possesses a low COD.

By this invention, therefore, corrosion of metal materials in contact with water can be effectively prevented without entailing the problem of environmental pollution.

The method of this invention for corrosion inhibition metal materials as described above is adaptable to water of any quality ranging from pure water, soft water, tap water, to industrial water. Concrete examples of the water system to which the method is effectively applicable are the boiler water system, the open or closed recirculating type cooling water system, the one-pass type cooling water system, the brine water system, the dust collecting water system used for part of converters, the cooling water system for dry pits in blast furnaces and converters, the water system for ammonia distillation columns in coke plants, the water system for incinerators in urban waste disposal plants, and the system for desalination of seawater.

Now, the present invention will be described more specifically below with reference to working examples and comparative experiments. This invention is not limited to the working examples so cited but may be practised otherwise without departing from the spirit of the invention disclosed herein.

EXAMPLES 1-3 AND COMPARATIVE EXPERIMENTS 1-4

In test water of varying quality indicated in Table 1 (with the quality invariably adjusted by suitable addition of varying chemicals; excepting the water system of Comparative Experiment 1 to which no chemical was added), a disk made of mild steel (spcc: 38 $cm^2$) was left rotating at 30° C. for 5 days to obtain a rate of corrosion. The results are shown also in Table 1.

TABLE 1

| Example | Quality of test water (*1) | Chemical Kind (*2) | Chemical Amount added (ppm) | Rate of Corrosion (mdd) |
|---|---|---|---|---|
| Example 1 | I | A | 20 | 4.7 |
| Example 2 | II | B | 20 | 9.7 |
| Example 3 | III | B | 20 | 13.2 |
| Comparative Experiment 1 | I | None added | — | 44.7 |
| Comparative 2 Experiment | II | C | 20 | 35.8 |
| Comparative 3 Experiment | IV | B | 20 | 43.3 |
| Comparative 4 Experiment | V | A | 20 | 79.1 |

*1: Kinds, I-V, of water quality are as shown in Table 2 below.

TABLE 2

| Water quality | I | II | III | IV | V |
|---|---|---|---|---|---|
| PH | 8.8 | 8.7 | 9.0 | 8.8 | 8.1 |
| MA | 250 | 200 | 350 | 250 | 100 |
| CaH | 250 | 200 | 350 | 250 | 100 |
| MgH | 100 | 60 | 150 | 100 | 40 |
| $C^-$ | 178 | 107 | 250 | 178 | 75 |
| $SO_4^{2-}$ | 100 | 60 | 150 | 100 | 42 |
| $SiO_2$ | 100 | 45 | 7 | 0 | 50 |
| Langelier index | 1.8 | 1.5 | 2.3 | 1.8 | 0.3 |
| $(SiO_2) \times (CaH)$ | 25000 | 9000 | 2450 | 0 | 5000 |
| Remark | Satisfying this invention | | | Comparison | |

*2: The chemicals, A-C, are identified below.
A = Hydrolyzed sodium salt of maleic anhydride/isobutylene copolymer (molecular weight 5,000).
B = Sodium maleate/isobutylene copolymer (molecular weight 13,000).
C = Maleic acid homopolymer (molecular weight 1,000).

It is noted from Table 1 that this invention manifests an outstanding corrosion inhibition effect and that no satisfactory corrosion inhibition effect is obtained when any one of the specific polymer, the specific Langelier index, and the specific value of $(SiO_2)\times(CaH)$ deviates from the respective ranges contemplated by this invention.

We claim:

1. A method for corrosion inhibtion of metal materials within an aqueous system comprising adding a copolymer having a molecular weight in the range of 1,000 to 20,000 and formed between isobutylene and at least one member selected from the group consisting of maleic acid, water-soluble salts thereof, and maleic anhydride to the aqueous system which comprises water of such quality that the Langelier index thereof is not less than 1.5 and the relation, $$(SiO_2)\times(CaH)\geqq 2{,}000$$

wherein $(SiO_2)$ stands for the $SiO_2$ concentration in said water (mg/liter) and (CaH) for the calcium hardness (mg/liter) as $CaCO_3$ in said water.

2. A method according to claim 1, wherein said water-soluble salt is sodium salt, amine salt, ammonium salt, or lithium salt.

3. A method according to claim 1, wherein the aqueous system under treatment has the quality thereof adjusted by addition thereto of at least one of a water-soluble carbonate, bicarbonate, calcium salt, and water-soluble silicate.

4. A method according to claim 1, wherein said copolymer is added to the water under treatment in an amount of 1 to 500 mg/liter.

5. A method according to claim 4, wherein said copolymer is added to said water in an amount of 2 to 100 mg/liter.

6. A method according to claim 1, wherein the total mol ratio of maleic acid, maleic anhydride, or a water-soluble salt thereof is not less than 10%.

7. A method according to claim 6, wherein the total mol ratio of maleic acid, maleic anhydride, or a water-soluble salt thereof is in the range of 25 to 75%.

8. A method for corrosion inhibition of metal materials in an aqueous system, comprising:

adjusting the quality of the aqueous system to be treated so that the Langelier index is not less than 1.5 and the relation, $$(SiO_2)\times(CaH)\geqq 2{,}000$$

wherein ($SiO_2$) stands for the $SiO_2$ concentration in said water (mg/liter) and (CaH) for the calcium hardness (mg/liter) as $CaCO_3$ in said water, and adding to said aqueous system a copolymer having a molecular weight in the range of 1,000 to 20,000, said copolymer being formed by isobutylene and at least one member selected from maleic acid, water-soluble salts thereof and maleic anhydride.

9. A method according to claim 8, wherein adjustment of quality of the aqueous system comprises adding at least one of calcium hardness component, silica component, M-alkalinity component and pH adjusting agent.

10. A method according to claim 8, further comprising adding at least one of auxiliary corrosion inhbition agents, scale preventing agents and slime control agents when the copolymer is added into the aqueous system.

11. A method according to claim 8, wherein said copolymer is added to the aqueous system in an amount of 1 to 500 mg/liter.

12. A method according to claim 8, wherein mol ratio of at least one of maleic acid, maleic anhydride and water soluble salt thereof is not less than 10%.

* * * * *